US007189338B2

(12) United States Patent
Kamoi et al.

(10) Patent No.: US 7,189,338 B2
(45) Date of Patent: Mar. 13, 2007

(54) IMAGE FORMING APPARATUS AND DEVELOPING DEVICE THEREFOR

(75) Inventors: Sumio Kamoi, Tokyo (JP); Tsuyoshi Imamura, Kanagawa (JP); Mieko Kakegawa, Kanagawa (JP); Noriyuki Kamiya, Kanagawa (JP); Kyohta Koetsuka, Kanagawa (JP); Masayuki Takeshita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 336 days.

(21) Appl. No.: 10/686,617

(22) Filed: Oct. 17, 2003

(65) Prior Publication Data

US 2004/0113118 A1 Jun. 17, 2004

(30) Foreign Application Priority Data

Oct. 17, 2002 (JP) ..... 2002-303201
May 2, 2003 (JP) ..... 2003-127165

(51) Int. Cl.
*G03G 15/08* (2006.01)

(52) U.S. Cl. ..... 252/62.54; 264/429

(58) Field of Classification Search ..... None
See application file for complete search history.

(56) References Cited

U.S. PATENT DOCUMENTS 4,137,188 A * 1/1979 Uetake et al. ..... 430/110.4
4,626,371 A * 12/1986 Ikenaga et al. ..... 252/62.54
4,793,691 A 12/1988 Enomoto et al.
4,984,873 A 1/1991 Takiguchi et al.
5,044,733 A 9/1991 Kamoi et al.
5,244,741 A 9/1993 Nagano et al.
5,513,026 A 4/1996 Suzuki et al.
5,566,013 A 10/1996 Suzuki et al.
5,970,294 A 10/1999 Narita et al.
6,070,038 A 5/2000 Imamura et al.
6,112,042 A 8/2000 Imamura et al.
6,198,895 B1 3/2001 Tsuda et al.
6,262,787 B1 7/2001 Kamoi et al.
6,287,246 B1 9/2001 Yoshii et al.
6,330,415 B1 12/2001 Imamura et al.
6,337,957 B1 1/2002 Tamaki et al.
6,338,900 B1 * 1/2002 Tada et al. ..... 428/402
6,342,557 B1 * 1/2002 Suzuki et al. ..... 524/432
6,379,759 B2 4/2002 Kamoi et al.
6,522,855 B1 2/2003 Katoh et al.

OTHER PUBLICATIONS

U.S. Appl. No. 10/440,108, filed May 19, 2003, Imamura et al.
U.S. Appl. No. 10/078,343, filed Feb. 21, 2002, Imamura et al.
U.S. Appl. No. 11/353,119, filed Feb. 14, 2006, Imamura.

* cited by examiner

*Primary Examiner*—C. Melissa Koslow
(74) *Attorney, Agent, or Firm*—Oblon, Spivak, McClelland, Maier & Neustadt, P.C.

(57) ABSTRACT

In a developing device for an image forming apparatus of the present invention, use is made of a magnetic molding produced by compression-molding a magnet compound material in a magnetic field. The magnet compound material contains, in addition to magnetic powder and fine, thermoplastic resin grains that are major components, at least one of a pigment and a charge control agent.

11 Claims, 16 Drawing Sheets

CIRCULARITY = b/a

FIG. 3

| wt % | STOPPING | STRENGTH (BENDING STRENGTH) | BREAKAGE | TOTAL |
|---|---|---|---|---|
| 0.08 | OCCURRED | 12.0 kg/mm$^2$ | NOT OCCURRED | × |
| 0.1 | OCCURRED | 11.0 kg/mm$^2$ | NOT OCCURRED | × |
| 0.3 | NOT OCCURRED | 10.4 kg/mm$^2$ | NOT OCCURRED | ○ |
| 0.5 | NOT OCCURRED | 8.5 kg/mm$^2$ | NOT OCCURRED | ○ |
| 0.8 | NOT OCCURRED | 7.0 kg/mm$^2$ | NOT OCCURRED | ○ |
| 1.0 | NOT OCCURRED | 5.0 kg/mm$^2$ | OCCURRED | × |

CIRCULARITY = b/a

GRAINS WITH CIRCULARITY OF 0.9 OR ABOVE

DIFFERENT MOLDING METHODS FOR EPXY COMPOUND ANISOTROPHIC Nd-Fe-B MAGNET

FIG. 15

| | MATERIAL | | | MOLDING CONDITIONS | | | CHARACTERISTICS | | |
|---|---|---|---|---|---|---|---|---|---|
| | MAGNETIC MATERIAL | BINDER MATERIAL | BINDER CONTENT (wt%) | MAGNETIC FIELD (Oe) | PRESSURE (ton/cm²) | BAKING CONDITIONS | DENSITY (g/cm³) | MAGNETIC FORCE/BHmax (mGOe) | STRENGTH (kg/mm²) |
| PRIOR ART | ANISO. Nd-Fe-B | EPOXY RESIN/HARDENER | 7.0 | 13,000 | 5.5 | 150°C60 | 5.0 | 10.2 | 7.0 |
| | ANISO. Nd-Fe-B | EPOXY RESIN/HARDNER | 7.0 | 13,000 | 7.5 | 150°C60 | 5.4 | 11.7 | 7.3 |
| | ANISO. Nd-Fe-B | EPOXY RESIN/HARDNER | 7.0 | 13,000 | 10.5 | 150°C60 | 5.9 | 13.1 | 7.8 |
| | ANISO. Nd-Fe-B | THERMOPLASTIC RESIN POWDER & SILICA GRAINS | 7.0 | 13,000 | 5.5 | 100°C30 | 5.1 | 11.1 | 3.4 |
| | ANISO. Nd-Fe-B | THERMOPLASTIC RESIN POWDER & SILICA GRAINS | 7.0 | 13,000 | 7.5 | 100°C30 | 5.5 | 12.2 | 3.6 |
| | ANISO. Nd-Fe-B | THERMOPLASTIC RESIN POWDER & SILICA GRAINS | 7.0 | 13,000 | 10.5 | 100°C30 | 5.9 | 13.6 | 3.8 |
| INVENTION | ANISO. Nd-Fe-B | FINE GRAINS (THERMOPLASTIC RESIN + CARBON BLACK) & SILICA GRAINS | 7.0 | 13,000 | 5.5 | 100°C30 | 5.4 | 13.0 | 3.3 |
| | ANISO. Nd-Fe-B | FINE GRAINS (THERMOPLASTIC RESIN + CARBON BLACK + CHARGE CONTROL AGENT + WAX) & SILICA GRAINS | 7.0 | 13,000 | 5.5 | 100°C30 | 5.4 | 13.1 | 3.3 |
| | ANISO. Nd-Fe-B | FINE GRAINS (THERMOPLASTIC RESIN + CARBON BLACK + CHARGE CONTROL AGENT + WAX) & SILICA GRAINS | 7.0 | 13,000 | 7.5 | 100°C30 | 5.8 | 14.9 | 3.5 |
| | ANISO. Nd-Fe-B | FINE GRAINS (THERMOPLASTIC RESIN + CARBON BLACK + CHARGE CONTROL AGENT + WAX) & SILICA GRAINS | 7.0 | 13,000 | 10.5 | 100°C30 | 6.1 | 16.3 | 3.8 |

IMAGE FORMING APPARATUS AND DEVELOPING DEVICE THEREFOR

BACKGROUND OF THE INVENTION

1. Field of the Invention

The present invention relates to a copier, facsimile apparatus, printer, direct digital master making apparatus or similar electrophotographic image forming apparatus. More particularly, the present invention relates to a developing device included in the image forming apparatus and using a magnetic force, a magnet roller for use in a developing roller included in the developing device, a magnet molding that forms part of the developing roller, and a magnet compound material for producing the magnet molding.

2. Description of the Background Art

It is a common practice with an electrophotographic image forming apparatus to form a latent image on a photoconductive drum, belt or similar image carrier in accordance with image data and then develop the latent image with a developing device to thereby produce a corresponding toner image. Development for such an electrophotographic system is, in many cases, uses a magnet brush. More specifically, when use is made of a two-component type developer made up of toner and magnetic grains, the developer is magnetically deposited on the surface of the image carrier, forming a magnet brush. In a developing zone where an electric field for development is formed between the image carrier and a developer carrier, the toner is selectively transferred from the magnet brush to the latent image on the image carrier by an electric field formed between the image carrier and a sleeve applied with an electric bias.

A developing device configured to satisfy both of developing conditions for increasing image density and those for forming a desirable low-contrast image (SLIC developing device hereinafter) is disclosed in, e.g., Japanese Patent Laid-Open Publication No. 2000-305360. The SLIC developing device, capable of solving problems relating to images formed by the two-component type developer, uses a developing roller characterized in that a main pole for development has a half-value width of 22° or 20°, as the case may be, and flux density of 100 mT to 130 mT. A half-value width refers to an angular width between positions where the magnetic force is one-half of the maximum magnetic force or peak of a magnetic force distribution curve in the normal direction, and has conventionally been about 50° in the case of the two-component type developer. Flux density in the case of the two-component type developer has conventionally been between 80 mT and 120 mT.

As stated above, the main pole of the SLIC developing device needs high flux density and a half-value width that is one-half of conventional one or less. As for a conventional ferrite magnet roller, a decrease in half-value width directly translates into a decrease in flux density, preventing required performance from being attained. It is therefore necessary to use a material having a high energy product. While the specifications of the developing roller are dependent on the type of an image forming apparatus and roller diameter, flux density of 100 mT to 130 mT is required of the main pole and poles adjoining it in recent image forming apparatuses, increasing the demand for a higher magnetic force. Translating flux density on a developing roller into a $(BH)_{max}$ value representative of the magnetic force of a magnet, 100 mT to 130 mT corresponds to 13 mGOe to 16 mGOe. Therefore, a magnet whose magnetic force is 13 mGOe or above is essential.

While Sm—Co, Nd—Fe—B and Sm—Fe—N rare earth magnets are known in the art as magnet materials having high energy products, today Nd—Fe—B and Sm—Fe—N are predominant over Sm—Co because Sm—Co is expensive. To provide the magnet with a desired configuration, it is necessary to use a so-called plastic magnet or resin magnet formed by kneading plastic resin.

Generally, a plastic magnet is produced by any one of injection molding, extrusion molding, and compression molding. These molding schemes each have merits and demerits, as will be described hereinafter. Injection molding can implement accurate molding because dimensions are determined by a mold. However, to allow a magnet material to flow through a mold with high fluidity, it is necessary to increase the blending ratio of resin while limiting the blending ratio of a magnet, preventing a magnet from achieving a strong magnetic force. Extrusion molding, which effects continuous molding, enhances productivity, but is lower in dimensional accuracy than injection molding. Further, extrusion molding, like injection molding, limits the blending ratio of a magnet and therefore a magnetic force. Compression molding increases density by pressing a magnet material and is desirable for providing a magnet with a strong magnetic force. However, compression molding is applicable only to small parts because it cannot produce large magnets without resorting to a large-scale press.

Further, the conventional molding schemes stated above use thermosetting resin without exception. Consequently, the resulting magnets can be stored only for an extremely short period of time and therefore cannot be stabilized in quality as products. In light of this, Japanese Patent Laid-Open Publication No. 4-11702, for example, discloses a method of producing a plastic magnet by mixing fine powder of resin and magnetic powder, molding the resulting powdery mixture by compression while applying or not applying a magnetic field, and heating the resulting molding. While this method is a kind of compression molding, the above resin powder is thermoplastic resin or so-called B-stage thermosetting resin. The magnetic powder is open to choice and may be anyone of, e.g., ferrite powder, rare earth-cobalt powder, alnico powder, and neodymium-iron-boron powder.

Generally, an anisotropic magnet material implements a stronger magnetic force than an isotropic magnet material. In the event of molding, an anisotropic magnet material is subject to a magnetic field for orientation in order to achieve a strong magnetic force. Today, an Nd—Fe—B material, which is provided with high anisotropy by high-temperature hydrogen processing, is available as a rare earth material with a strong magnetic force, as taught in, e.g., Japanese Patent Laid-Open Publication Nos. 10-13517 and 8-31677.

Although plastic, rare earth magnet molding produced by the injection molding or the protrusion molding of isotropic Nd—Fe—B is available on the market, the magnetic force of such a magnet molding is only 6 mGOe to 9 mGOe in terms of $(BH)_{max}$. To provide a magnet for the SLIC developing device with a magnetic force of 13 mGOe or above, we studied the use of an anisotropic Nd magnet having the strongest magnetic force available today. However, when injection molding or protrusion molding was used, even the anisotropic Nd magnet exhibited a magnetic force of only 10 mGOe to 12 mGOe short of 13 mGOe.

We therefore conducted a series of extended researches and experiments for finding a compression molding method implementing the strongest magnetic force. An anisotropic material must be subject to a magnetic field during molding. Apart from the teachings of Laid-Open Publication No.

4-11702 mentioned earlier, a compound for compression molding is usually implemented by an epoxy material, which is thermosetting resin. The epoxy resin and a hardener are blended by 1 wt. % to 10 wt. % and deposited on magnet powder to thereby constitute a dry compound. However, to make the epoxy resin a dry compound, it is necessary to use solid epoxy resin and a solid harder. While many different materials, including aromatic amine, dicyan-diamide and imidazole, are available for a solid hardener, such materials all have high setting points and need at least 150° C. In addition, a setting time as along as 60 minutes or more is required.

However, magnet materials in general undergo demagnetization when subjected to heat. The anisotropic Nd magnet material, in particularly, is extremely susceptible heat; the magnetic characteristic $(BH)_{max}$ decreases by about 15% when heated at, e.g., 150° C. for 30 minutes.

As for compression molding effected in a magnetic field, a magnetic force is increased by improving density and by enhancing orientation with the magnetic field. However, a problem with the epoxy compound is that density cannot be increased without resorting to high pressure. More specifically, to achieve 13 mGOe, density of 6.1 g/cm$^3$ and therefore pressure of 7.0 ton/cm$^2$ is required. Taking account of the demagnetization by 15% mentioned above, density of 6.55 g/cm$^3$ and therefore pressure of 11.1 ton/cm$^2$ is necessary.

For example, assuming a 3 mm wide, 2.5 mm high, 30.4 cm long rectangular magnet, a pressing area and a pressure required of a horizontal magnetic field system, which applies a magnetic field in a direction perpendicular to a pressing direction, are 7.6 cm$^2$(=0.25×30.4) and 84.42 tons, respectively. As a result, a press belonging to a 100-ton class must be used.

In the case of magnetic Field type of compression molding, after a mold has been located between a pair of electromagnets, a magnetic field is applied between the electromagnets for thereby orienting a magnet. At this instant, the magnetic field is dependent on a gap between the electromagnets, more precisely between iron cores thereof; the narrower the gap, the stronger the magnetic force. The gap between the upper and lower punches of a conventional magnet molding section is 10 mm, so that the pressure of the mold cannot be increased. Consequently, high-pressure damages the mold. It is therefore desirable to use pressure low enough to protect the mold from damage.

SUMMARY OF THE INVENTION

It is an object of the present invention to increase the magnetic force of even a magnet produced by low-pressure compression molding by improving orientation in the event of magnetic field type of molding, a magnet roller using the magnet, and a compound material for a resin-coupled type of magnet.

It is another object of the present invention to provide a developing device including the above magnet roller.

It is a further object of the present invention to provide an image forming apparatus including the above developing device.

A magnet compound material of the present invention contains magnetic powder and fine, thermoplastic resin grains as major components. The compound material additionally contains at least one of a pigment and a charge control agent.

BRIEF DESCRIPTION OF THE DRAWINGS

The above and other objects, features and advantages of the present invention will become more apparent from the following detailed description taken with the accompanying drawings in which:

FIG. 3 is a table listing experimental results showing a relation between the amount of a fluidity imparting agent and the degree of stop-up;

FIG. 15 is a table comparing the present invention and prior art as to physical properties available with molding of a binder resin.

DESCRIPTION OF THE PREFERRED EMBODIMENT

Figure 1:
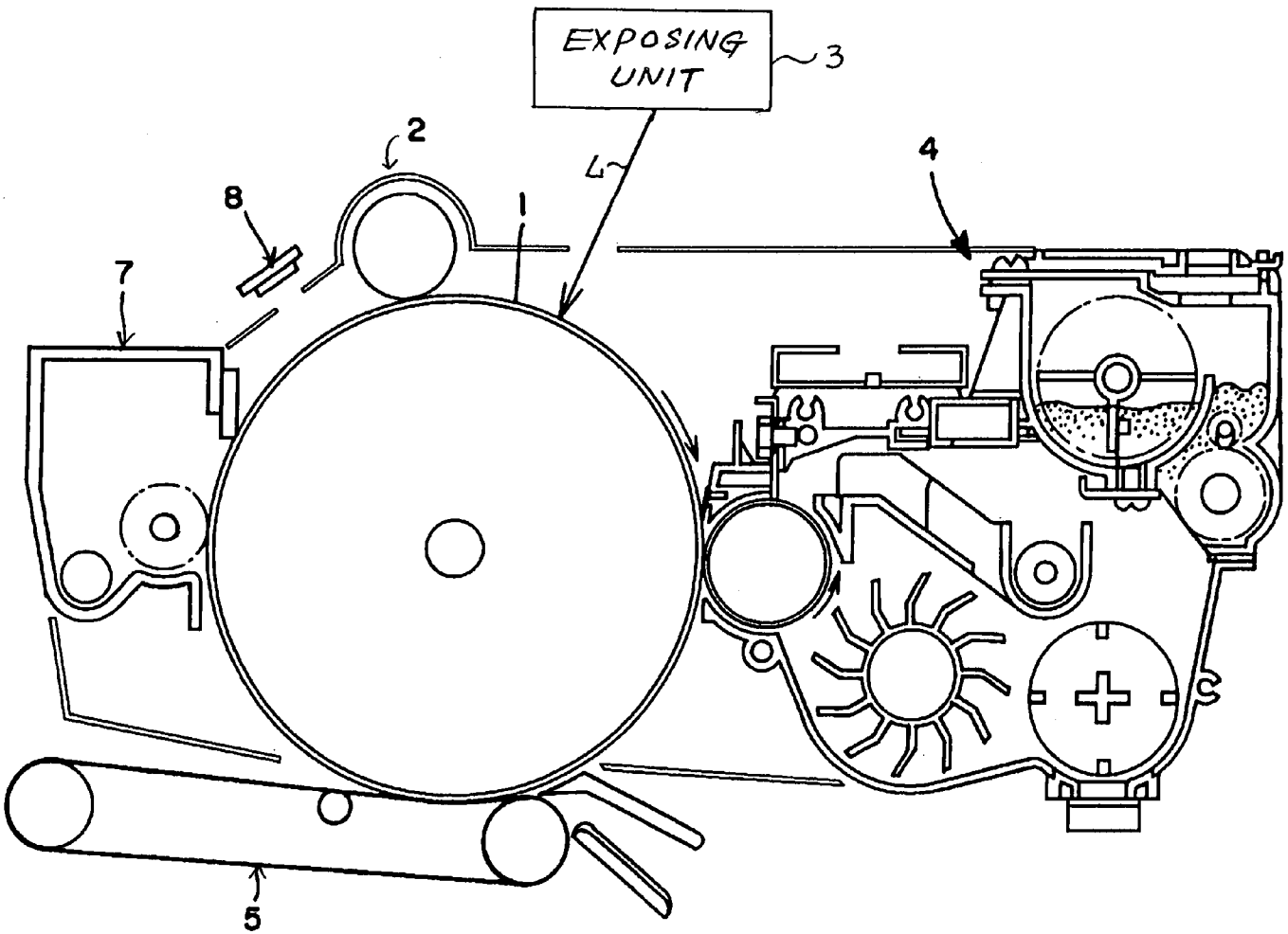
FIG. 1 is a view showing the general construction of an image forming apparatus in accordance with the present invention.

Referring to FIG. 1 of the drawings, an image forming apparatus embodying the present invention is shown and includes a photoconductive drum or image carrier 1. Arranged around the drum 1 are a charger 2, an exposing unit 3, a developing device 4, an image transferring device 5, a cleaning device 7, and a quenching lamp 8.

The charger 2, implemented as a charge roller by way of example, uniformly charges the surface of the drum 1. The exposing unit 3 scans the charged surface of the drum 1 with, e.g., a laser beam L to thereby form a latent image on the drum 1. The developing device 4 develops the latent image with toner for thereby producing a corresponding toner image. The image transferring device 5 transfers the toner image from the drum 1 to a sheet or recording medium, which is fed from a tray not shown, with a belt or a roller and a charger byway of example. Subsequently, a fixing unit, not shown, fixes the toner image on the sheet. The cleaning device 7 removes toner left on the drum 1 after image transfer while the quenching lamp 8 discharges the surface of the drum 1 thus cleaned for thereby preparing it for the next image forming cycle.

At least the drum 1 and developing device 4 may be constructed into a cartridge unit or may alternatively be constructed into a process cartridge together with the charger 2, cleaning device 7 and quenching lamp 8. A process cartridge refers to a removable unit including the developing device 4 and other process means. Even the cartridge unit mentioned above may constitute a process cartridge. Further, the developing device 4, drum 1 and charger 2 or the developing device 4, drum 1, charger 2 and cleaning device 7 may be combined by way of example.

The developing device 4 includes a developing roller made up of a magnet roller affixed to the device 4 and a nonmagnetic sleeve rotatable around the magnet roller.

Because the basic configurations of the image forming apparatus and developing roller described above are conventional, the following description will concentrate on the magnet roller characterizing the present invention.

Figure 2:
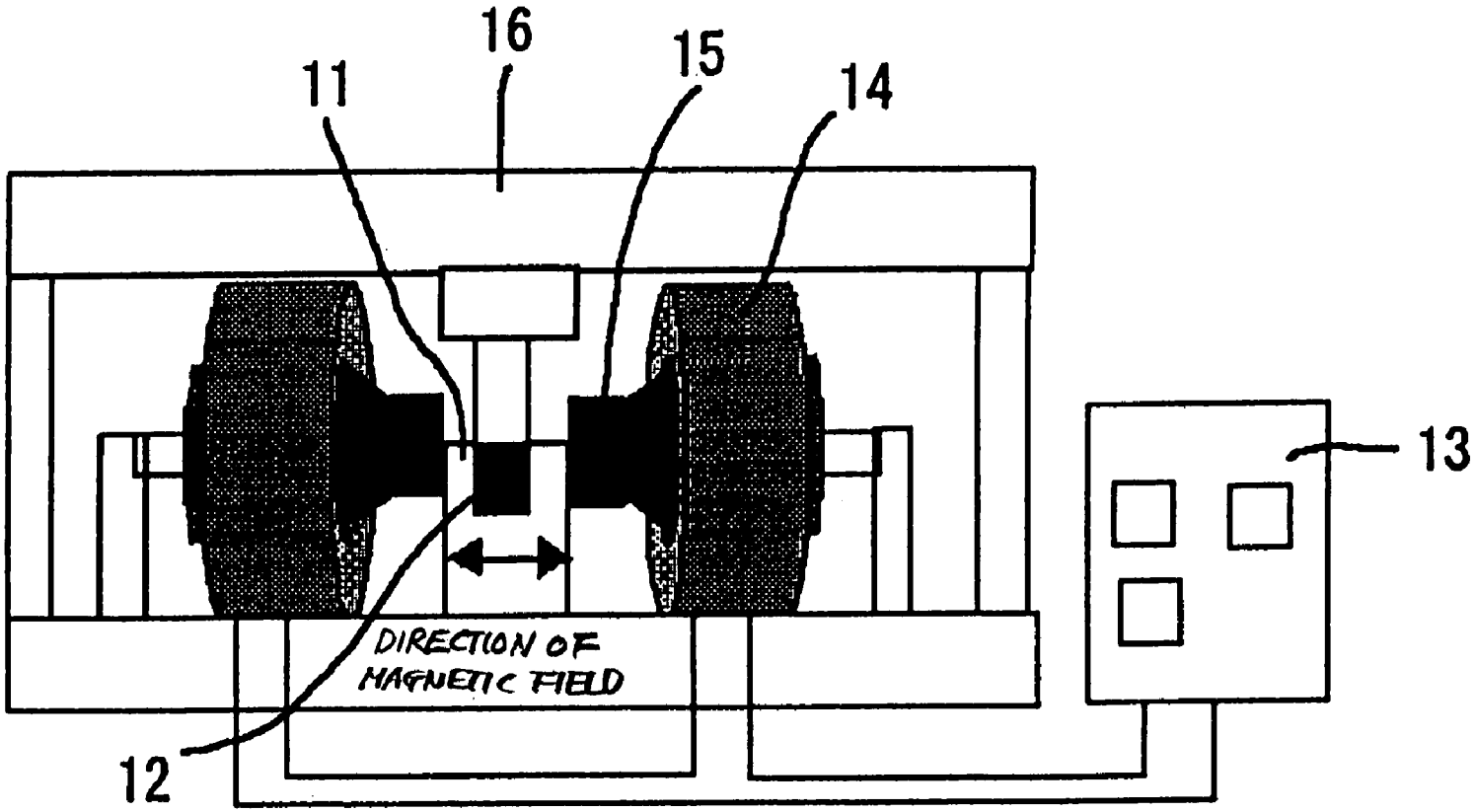
FIG. 2 is a view showing a specific configuration for compression-molding a magnet molding in a magnetic field and effecting horizontal magnetic field type of orientation.

FIG. 2 shows a specific configuration for compression-molding a particular magnet, which corresponds in position to the main pole or developing pole of a magnet roller in accordance with the present invention, and effecting horizontal magnetic field type of orientation. As shown, after magnetic powder 12 has been packed in a mold 11, a DC electric field is applied from an orientation power supply 13 so as to cause a hollow-core coil 14 and an iron core or electromagnet 15 to orient a magnet. In this condition, a press 16 presses the oriented magnet.

Thermoplastic resins applicable to the magnet roller of the present invention include homopolymers of styrene and its substitutes such as polystyrene, polychloroethylene and polyvinyltoluene; styrene-based copolymers such as, styrene-P-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile polymer, styrene-vinyl methyl ether polymer, styrene-vinyl methyl ketone polymer, styrene-butadiene copolymer, styrene-isoprene copolymer, styrene-acrylonitrile-indene copolymer, styrene-maleic acid copolymer, and styrene-maleic ester copolymer; polymethyl methacrylate; polybutyl methacrylate; polyvinyl chloride; polyvinyl acetate; polyethylene; polypropylene; polyester; polyvinyl butyral; poly acrylic acid resin; rosin; modified rosin; terpene resin; and phenol resin. The content of the resin is between 85% to 95% for the entire composition except for magnetic powder. The above materials may be used either singly or in combination.

The fine grains of thermoplastic resin or thermosoftening resin play the role of a binder for binding the magnetic grains. Conventional resin grains, e.g., epoxy resin grains deposited on the periphery of the magnetic powder are liable to bring about cohesion of the magnetic grains and lower orientating property. The dispersion type of fine resin grains of the present invention realizes easy orientation and high magnetization, compared to a binder of the type depositing on the periphery of a magnet. Also, the thermoplastic resin can bind magnet grains when subject to temperature at which the resin melts or softens, thereby reducing the baking time and therefore thermal demagnetization In accordance with the present invention, use is made of at least a pigment and a charge control agent in addition to the thermoplastic resin. A parting agent is also added in order to promote parting after molding. The mixture of the thermoplastic resin, pigment, charge control agent and parting agent is melted and kneaded by a heating kneader, tri-roll mill or similar apparatus capable of effecting heating and mixing, and then cooled off. The mixture thus prepared is then pulverized to a grain size of 1 μm to 50 μm by a pulverizer, e.g., a jet mill or a ball mill to obtain a desired compound material.

While the thermoplastic resin serves as a binder for the mixture, a material with a low softening point coheres after pulverization, so that fine grains sized 10 μm or less cannot be easily obtained. To obviate cohesion after pulverization, a pigment is added by kneading. The pigment was found to greatly improve the characteristics of a magnet molding. The pigment may be any one of carbon black (oil furnace black, channel black, lamp black, acetylene black, etc.), Cadmium Yellow, Mineral Fast Yellow, Nickel Titanium Yellow, Molybdenum Orange, Permanent Orange, red oxide, Cadmium Red, Methyl Violet Lake, Cobalt Blue, Alkali Blue and the like. Such pigments may be either singly or in combination. The amount of the pigment added is between 1 wt. % and 20 wt. %, preferably between 5 wt. % and 10 wt. %.

The charge control agent is added to improve dispersiveness of the magnet grains and fine, thermoplastic resin grains. The charge control agent was also found to improve the characteristics of a magnet molding. The charge control agent may be any one of Nigrosine, a quaternary ammonium salt, a metal-containing azo dye, and a complex of salicylic acid. The amount of the charge control agent added is between 1 wt. % and 20 wt. %, preferably between 2 wt. % and 10 wt. %.

As for the parting agent added to promote parting after molding, there may be used any one of synthetic waxes including low molecular weight polyethylene and propylene; vegetable waxes such as candellila wax, carnauba wax, rice wax, Japan wax and jojoba oil; animal waxes including beewax, lanolin and spermaceti; mineral waxes including montan wax and ozokerite; fats and oils-based waxes including hardened castor oil, hydroxystearic acid, fatty acid amide, and phenol fatty acid ester. The addition amount is between 1 wt. % and 20 wt. %, preferably between 2 wt. % and 10 wt. %.

Further, to uniformly mix the magnetic powder and resin grains, a fluidity imparting agent is added to the pulverized mixture of thermoplastic resin, pigment, charge control agent and parting agent. The fluidity imparting agent noticeably enhances the fluidity of the powder and allows it to be uniformly fed to and packed in a mold. This successfully obviates bridging ascribable to gaps and implements uniform density while reducing irregularity in magnetic force in the event of magnet field type of molding. The fluidity imparting agent may be any one of, e.g., silica, titanium oxide, aluminum oxide, Teflon (trade name), stearic acid metal or similar lubricant, cerium, and talk. The ratio of the fluidity imparting agent to the entire compound material is between 0.1 wt. % and 1 wt. %, preferably between 0.3 wt. % and 0.8 wt. % as shown in FIG. 3.

The fluidity imparting agent improves fluidity, but checks the binder effect and thereby lowers magnet strength. The minimum content of the fluidity imparting agent necessary for improving fluidity is 0.1 wt. % although it depends on the grain size and material of the magnet as well as on the material and grain size of the fluidity imparting agent. Magnet strength is also dependent on the grain size and material of the magnet as well as on the grain size and material of the fluidity imparting agent; a content above 1 wt. % would lower adhesion to thereby lower magnet strength. Fluidity is estimated in terms of how easily the material flows through a piping. A material with high fluidity flows through a piping without stopping it up while a material with low fluidity stops up the piping. The size of the piping should be smaller than the width of a mold (2.3 mm) and was selected to be 2.0 mm.

Many of fluidity imparting agents are highly water-absorptive and are not constant in the amount of grains even if mixed in a preselected amount and are therefore susceptible to production environment. In light of this, it is preferable to use fine powdery grains improved in water absorbability by hydrophobic processing.

Figure 4:
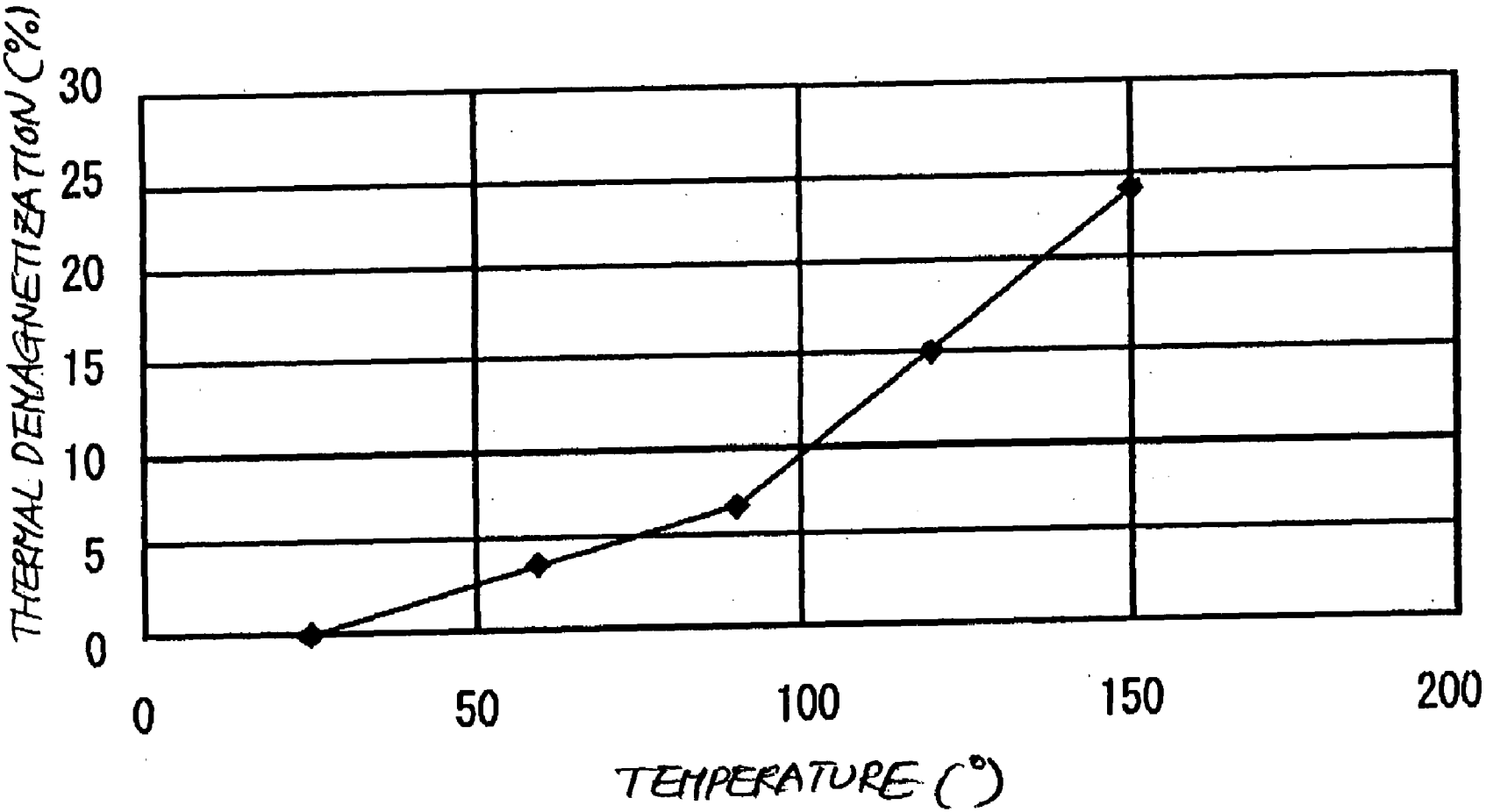
FIG. 4 is a graph showing a relation between temperature and the thermal demagnetization of an anisotropic Nd—Fe—B material.

In accordance with the present invention, the softening point of the thermoplastic resin grains should preferably be 90° C. or below. Magnet materials in general decrease in magnetic force when subjected to heat. This is particularly true with anisotropic Nd—Fe—B materials. FIG. 4 shows a relation between the thermal demagnetization ratio and temperature. As shown, a polarity transition point appears at 90° C.; the thermal demagnetization ratio increases when temperature exceeds 90° C. Data shown in FIG. 4 were determined at room temperature after 30 minutes of heating.

Figure 5A:
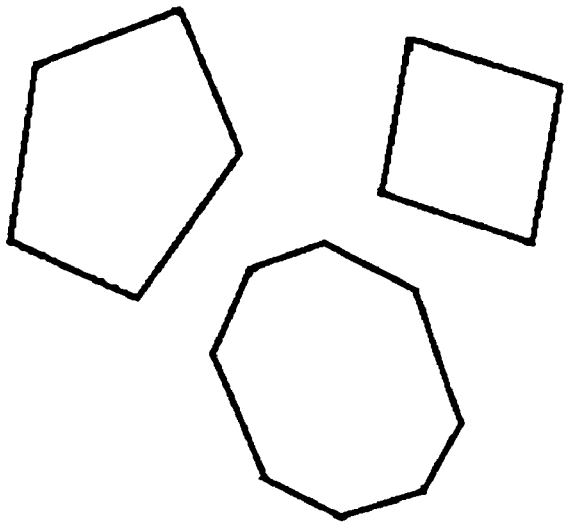
FIG. 5A shows specific fine grains of resin produced by pulverization.
Figure 5B:
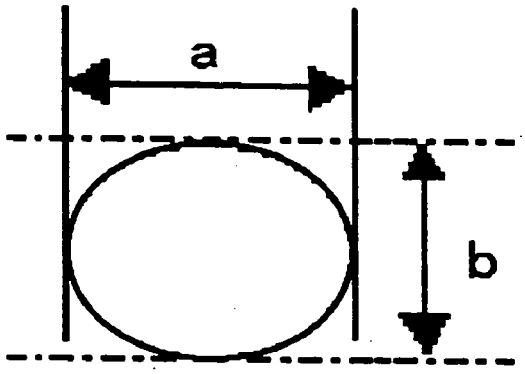
FIG. 5B shows specific fine grains of resin produced by polymerization.
Figure 6A:
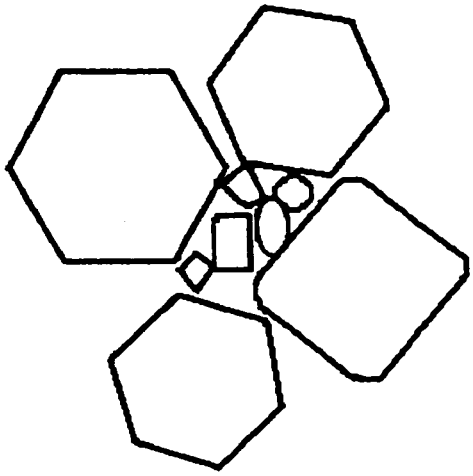
FIGS. 6A and 6B respectively correspond to FIGS. 5A and 5B, each showing a particular condition in which the fine grains are packed in the gaps between the grains of magnetic powder.
Figure 6B:
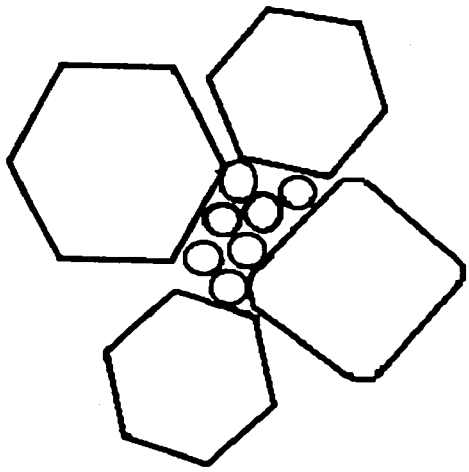

FIG. 5A shows conventional fine resin grains produced by pulverizing resin pellets and having amorphous shapes. FIG. 5B shows a resin grain produced by polymerization in accordance with the present invention and having a highly circular, spherical shape; circularity should preferably be 0.9 or above. When such spherical grains are used as a binder, they easily fill up gaps between magnet grains and improve density in the event of pressing for thereby increasing a magnetic force. Further, the above grains reduce gaps to thereby enhance strength. Polymerization may be either one of emulsification polymerization and suspension polymerization. FIGS. 6A and 6B respectively show the conventional pulverized resin grains and the grains of the present invention each filling a gap between magnet grains. The mixture of resin grains, pigment, charge control agent and parting agent is also desirable in density and strength when implemented as spherical grains.

To provide a particular pole of an SLIC developing roller with flux density of 100 mT or above, the magnetic force of the particular pole must be 13 mGOE or above. Stated another way, a magnet molding to be used must have a magnetic force of 13 mGOe or above. While the magnetic force of a plastic magnet may advantageously be increased by increasing the content of the magnetic powder, i.e., decreasing the content of the other components, it is important to increase the content of the binder resin for increasing magnet strength. Therefore, to implement magnet strength of, e.g., 7.0 kg/mm$^2$ while insuring the above magnetic force, the ratio of the components other than the magnetic powder to the entire compound material should preferably be between 3 wt. % and 10 wt. %.

Gaps between magnet grains should preferably be packed with the thermoplastic resin grains or the mixture other than the magnetic powder. For this purpose, it is preferable to reduce the mean grain size of the thermoplastic resin grains to one-tenth of the mean grain size of the magnet grains or less. While the size of the magnet grains depends on the material of the same, an Nd—Fe—B material subjected to high-temperature hydrogen heat processing has a mean grain size of 100 μm to 120 μm. In this condition, thermoplastic resin grains with a grain size of 10 μm to 12 μm successfully increase density and therefore improve magnetic characteristics.

Further, to attain a magnet with a strong magnetic force, it is preferable to produce a magnet molding by compression molding in a magnetic field. While an anisotropic material implements a stronger magnetic force than an isotropic material, use may be made of an isotropic material, if desired. Particularly, an anisotropic Nd—Fe—B or Sm—Fe—N material realizes a strong magnetic force. More preferably, the magnet compound material should be subject to compression molding in a magnetic field while being heated at temperature lower than the softening point of the thermoplastic resin. In this connection, if temperature inside a mold is higher than the softening point of the thermoplastic resin, then the resin softens or melts and causes the compound material to cohere. This makes it difficult to implement uniform packing and thereby makes density distribution irregular. So long as the resin is heated at temperature lower than the softening point, it becomes soft and increases molding density, improves orientation, and realizes a strong magnetic force. The heating temperature should preferably be lower than the softening point by 10° C. to 40° C., more preferably by 20° C. to 30° C.

Figure 7:
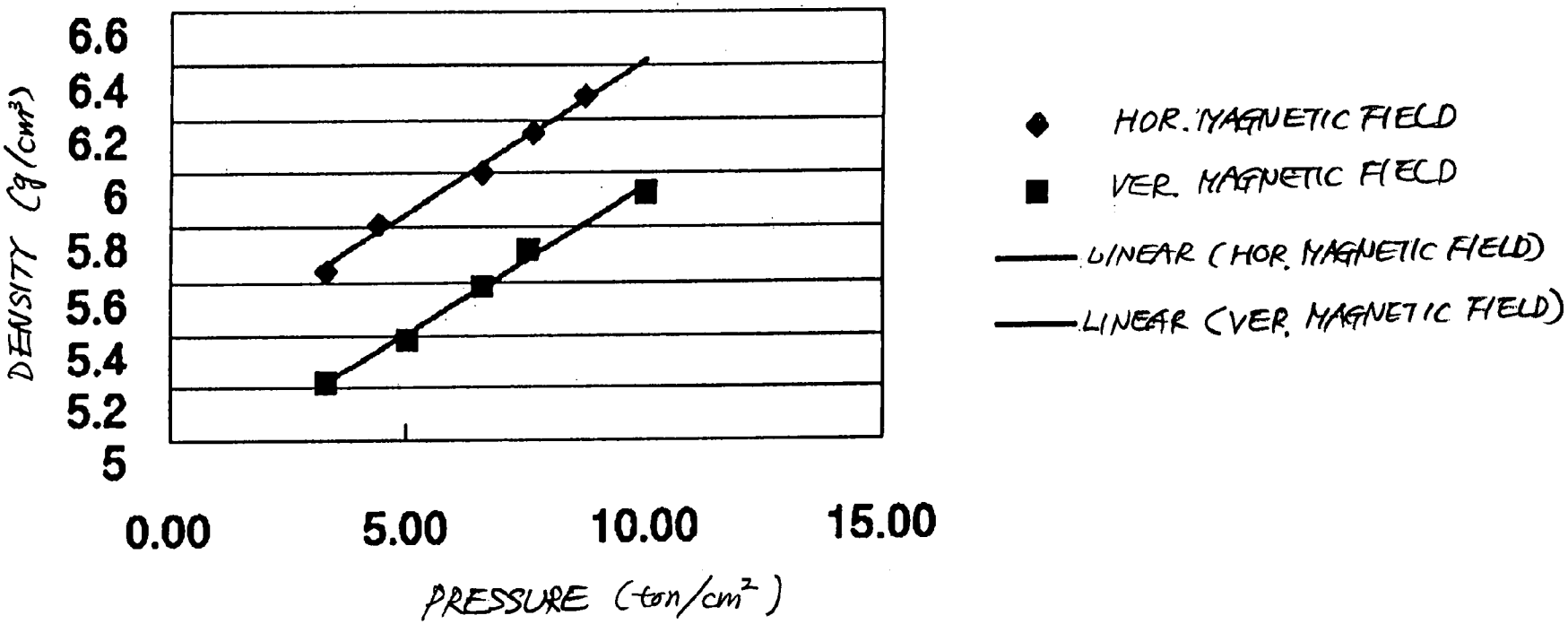
FIG. 7 is a graph showing a relation between molding density and pressure.

The orientation of the magnet should advantageously be perpendicular to the direction of pressing. FIG. 7 compares vertical magnetic field molding and horizontal magnetic field molding as to a relation between density and pressing pressure. As shown, in the case of vertical magnetic field molding that applies a magnetic field in a direction parallel to the pressing direction, the orientation of the magnet is coincident with the pressing direction and therefore constitutes resistance in the event of pressing, making it difficult to increase density. By contrast, in the case of horizontal magnetic field molding that applies a magnetic field in a direction perpendicular to the pressing direction, the orientation exerts a minimum of resistance in the event of pressing and therefore serves to increase density and magnetic force. More specifically, to increase the magnetic force of an anisotropic magnet, it is important to improve density and orientation; a magnetic force can be increased by increasing density.

The horizontal direction is the direction of the magnetic field, establishing N and S orientation. Therefore, when the magnet is set in a groove formed in the magnet roller, the horizontal direction coincides with the direction of thickness of the magnet roller. The horizontal direction is determined by the dimensions of a mold and therefore stable in dimensional accuracy. On the other hand, the dimensional accuracy in the direction of height, i.e., the pressing direction is dependent on the pressure and the amount of magnet packing. As for the developing roller, the thickness of the rare earth magnet must have accuracy of 0.05 mm or less because the flux density is noticeably dependent on the thickness of the magnet. Although the width of the rare earth magnet influences flux density and half-value width, the influence is less noticeable than the influence of thickness. It follows that horizontal magnetic field molding, which stabilizes dimensional accuracy in the direction of height, stabilizes flux density as well, i.e., reduces deviation.

Specific examples of the present invention and comparative examples will be described hereinafter.

EXAMPLE 1

To produce a compound material, 7 pts.wt. of fine grains having the following composition and blending ratio was mixed with 93 pts.wt. of anisotropic Nd—Fe—B magnetic powder, MFP-12 (trade name) available from Aichi Steel Works Co., Ltd. and having a mean grain size of 102 μm and then dispersed by agitation. First, to prepare the above fine grains, the resin grains, pigment, charge control agent and parting agent were mixed, dispersed in a molten state by heat above the softening point 75° C. of the resin, pulverized into fine grains after dispersion, and then added with the fluidity imparting agent. The mean grain size of the compound material was 8.5 μm.

Thermoplastic Resin:

| | |
|---|---|
| 1. polyester resin | 79 pts. wt. |
| 2. styrene acryl resin | 7 pts. wt. |

Pigment:

| | |
|---|---|
| carbon black | 7.6 pts. wt. |

Charge Control Agent:

| | |
|---|---|
| zirconium salicylate | 0.9 pts. wt. |

Parting Agent:

| | |
|---|---|
| mixture of carnauba wax and rice wax | 4.3 pts. wt. |

Fluidity Imparting Agent:

| | |
|---|---|
| hydrophobic silica | 1.2 pts. wt |

The resulting compound material was packed in the mold 11 that was 2.3 mm wide, 4.1 mm high, and 306 mm long. A DC electric field was applied to generate a magnetic field of 13,000 Oe. In this condition, the compound material was pressed by 5.5 ton/cm$^2$ at room temperature. In this case, the direction of magnetic field corresponds to the direction of width of the magnet.

A magnet molding, i.e., an Nd—Fe—B magnet thus produced had width of 2.03 mm corresponding to the height of the mold, height of 2.35 mm corresponding to the width of the mold, length of 306.3 mm, and density of 5.32 g/cm$^3$. The magnet was then heated at 100° C. for 30 minutes and then subjected to pulse wave magnetization in a magnetic field of 25 T to thereby complete a rare earth magnet. The rare earth magnet had a magnetic force $BH_{max}$ of 13.7 mGOe, as measured by a VSM meter.

On the other hand, a magnet compound material made up of a ferrite magnet and EEA resin was molded by extrusion molding in a magnetic field to thereby produce a magnet roller tube having a diameter of 16 mm. Subsequently, a metallic core having a diameter of 6 mm was inserted in the bore of the tube. At this instant, a groove was present at the position of the metallic core corresponding to the main pole or developing pole P1. The groove was 2.25 mm deep, 2.5 mm wide, and 306.1 mm long.

Figure 8:
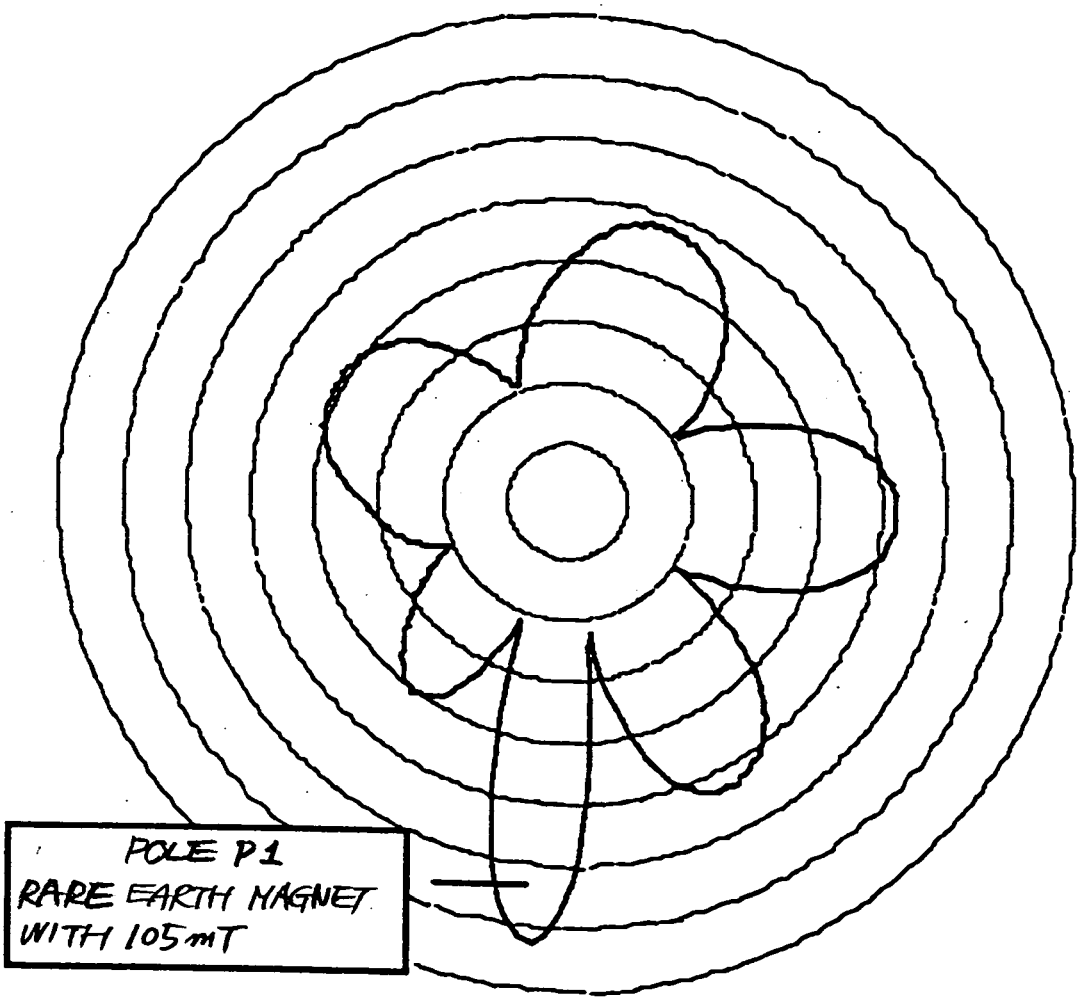
FIG. 8 is a chart showing the flux density distributions particular to a developing roller produced by Example 1 of the present invention.

The magnet molding stated above was fitted in the groove and then affixed by instantaneous adhesive. Subsequently, the molding was magnetized by yoke magnetization to thereby form various poles. Finally, a sleeve and flange were mounted to complete a developing roller. FIG. 8 shows the flux density distributions attained with the developing roller. The main pole P1 had a half-value width of 180 and flux density of 105 mT, as measured with a sensor located at a distance of 1 mm from the magnet.

EXAMPLE 2

To produce a compound material, 7 pts.wt. of fine grains having the following composition and blending ratio were mixed with 93 pts.wt. of anisotropic Nd—Fe—B magnetic powder MFP-12 having a mean grain size of 105 μm and then dispersed by agitation. First, to prepare the above fine grains, the resin grains and charge control agent were mixed, dispersed in a molten state by heat above the softening point 78° C. of the resin, pulverized into fine grains after dispersion, and then added with the fluidity imparting agent. The mean grain size of the compound material was 7.9 μm.

Thermoplastic Resin:

| | |
|---|---|
| polyester resin | 97.5 pts. wt. |

Charge Control Agent:

| | |
|---|---|
| zirconium salicylate | 1.0 pts. wt. |

Fluidity Imparting Agent:

| | |
|---|---|
| hydrophobic silica | 1.5 pts. wt |

The resulting compound material was packed in the mold 11 that was 2.3 mm wide, 4.1 mm high, and 306 mm long. A DC electric field was applied to generate a magnetic field of 13,000 Oe. In this condition, the compound material was pressed by 5.5 ton/cm$^2$ at room temperature by horizontal, magnetic field type of molding. In this case, the direction of magnetic field corresponds to the direction of width of the magnet.

A magnet molding, i.e., an Nd—Fe—B magnet thus produced had width of 2.05 mm corresponding to the height of the mold, height of 2.34 mm corresponding to the width of the mold, length of 306.2 mm, and density of 5.25 g/cm$^3$. The magnet was then heated at 100° C. for 30 minutes and then subjected to pulse wave magnetization in a magnetic field of 25 T to thereby complete a rare earth magnet. The rare earth magnet had a magnetic force $BH_{max}$ of 13.1 mGOe, as measured by a VSM meter.

On the other hand, a magnet compound material made up of a ferrite magnet and EEA resin was molded by extrusion molding in a magnetic field to thereby produce a magnet roller tube having a diameter of 16 mm. Subsequently, a metallic core having a diameter of 6 mm was inserted in the bore of the tube. At this instant, a groove was present at the position of the metallic core corresponding to the main pole or developing pole P1. The groove was 2.25 mm deep, 2.5 mm wide, and 306.1 mm long.

Figure 9:
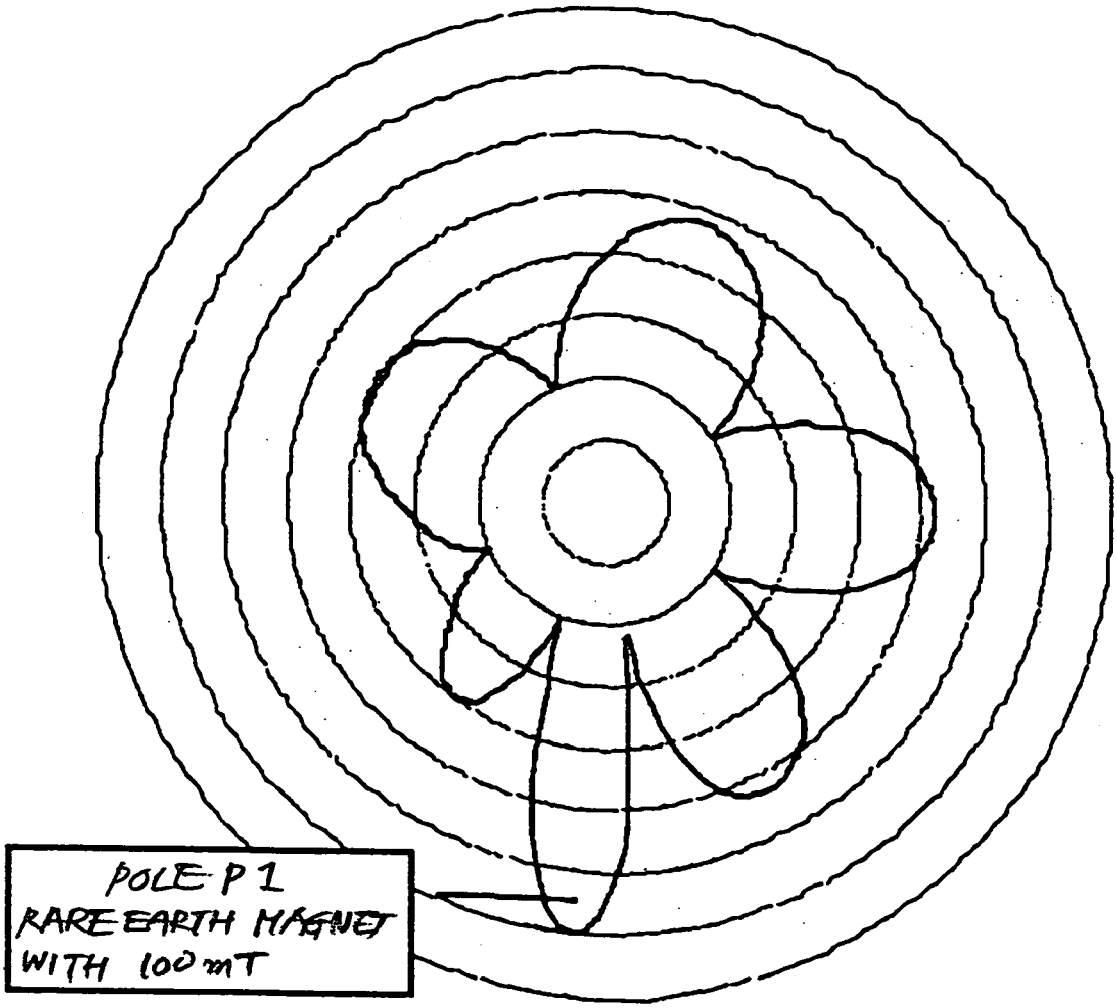
FIG. 9 is a chart showing the flux density distributions particular to a developing roller produced by Example 2 of the present invention.

The magnet molding stated above was fitted in the groove and then affixed by instantaneous adhesive. Subsequently, the molding was magnetized by yoke magnetization to thereby form various poles. Finally, a sleeve and flange were mounted to complete a developing roller. FIG. 9 shows the flux density distributions attained with the developing roller. The main pole P1 had a half-value width of 18° and flux density of 100 mT, as measured with a sensor located at a distance of 1 mm from the magnet.

EXAMPLE 3

To produce a compound material, 7 pts.wt. of fine grains having the following composition and blending ratio were mixed with 93 pts.wt. of anisotropic Nd—Fe—B magnetic powder MFP-12 having a mean grain size of 102 μm and then dispersed by agitation. First, to prepare the above fine grains, the resin grains and pigment were mixed, dispersed in a molten state by heat above the softening point 67° C. of the resin, pulverized into fine grains after dispersion, and then added with the fluidity imparting agent. The mean grain size of the compound material was 7.3 μm.

Thermoplastic Resin:

| | |
|---|---|
| polyester resin | 91.2 pts. wt. |

Pigment:

| | |
|---|---|
| carbon black | 7.6 pts. wt. |

Fluidity Imparting Agent:

| | |
|---|---|
| hydrophobic silica | 1.2 pts. wt |

The resulting compound material was packed in the mold 11 that was 2.3 mm wide, 4.1 mm high, and 306 mm long. A DC electric field was applied to generate a magnetic field of 13,000 Oe. In this condition, the compound material was pressed by 5.5 ton/cm$^2$ at room temperature by horizontal magnetic field molding. In this case, the direction of magnetic field corresponds to the direction of width of the magnet.

A magnet molding, i.e., an Nd—Fe—B magnet thus produced had width of 2.03 mm corresponding to the height of the mold, height of 2.35 mm corresponding to the width of the mold, length of 306.2 mm, and density of 5.28 g/cm$^3$. The magnet was then heated at 100° C. for 30 minutes and then subjected to pulse wave magnetization in a magnetic field of 25 T to thereby complete a rare earth magnet. The rare earth magnet had a magnetic force $BH_{max}$ of 13.2 mGOe, as measured by a VSM meter.

On the other hand, a magnet compound material made up of a ferrite magnet and EEA resin was molded by extrusion molding in a magnetic field to thereby produce a magnet roller tube having a diameter of 16 mm. Subsequently, a metallic core having a diameter of 6 mm was inserted in the bore of the tube. At this instant, a groove was present at the position of the metallic core corresponding to the main pole or developing pole P1. The groove was 2.25 mm deep, 2.5 mm wide, and 306.1 mm long.

Figure 10:
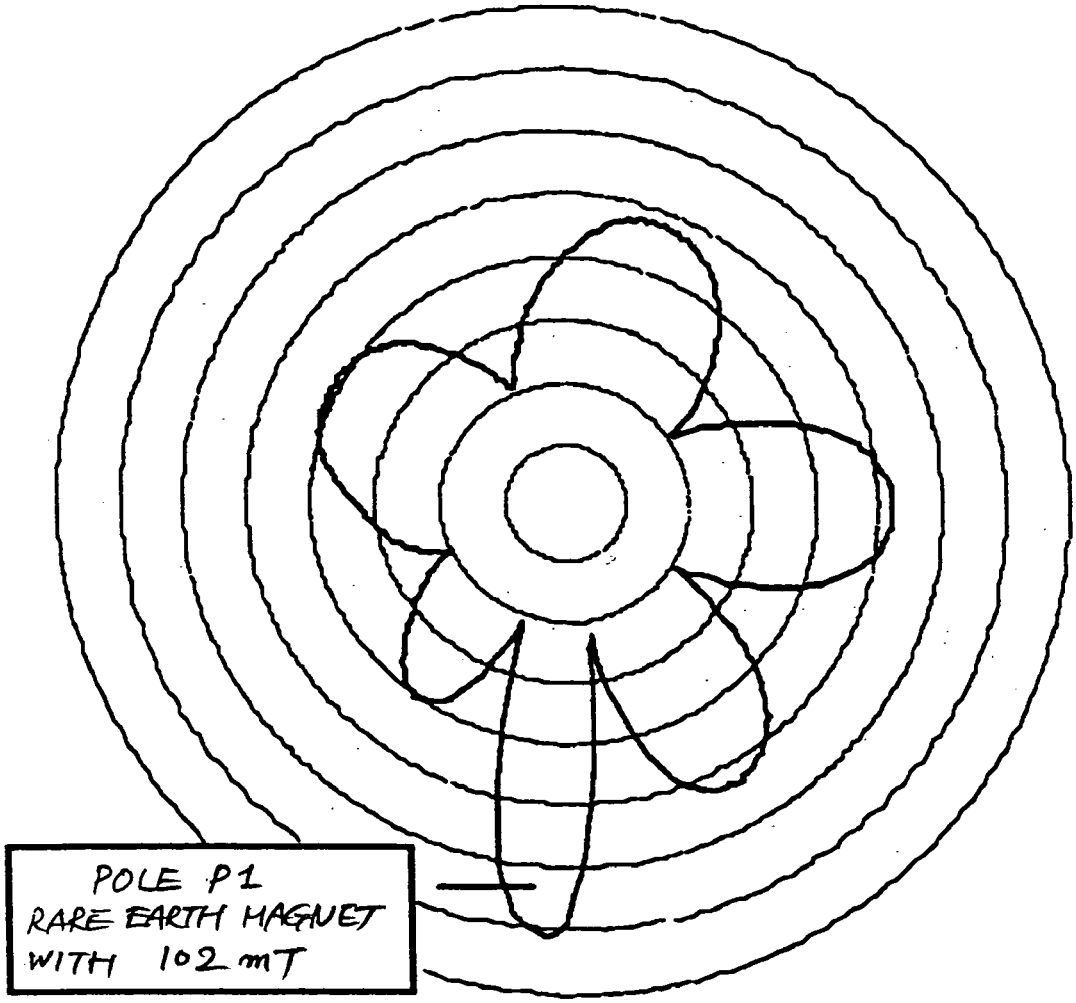
FIG. 10 is a chart showing the flux density distributions particular to a developing roller produced by Example 3 of the present invention.

The magnet molding stated above was fitted in the groove and then affixed by instantaneous adhesive. Subsequently, the molding was magnetized by yoke magnetization to thereby form various poles. Finally, a sleeve and flange were mounted to complete a developing roller. FIG. 10 shows the flux density distributions attained with the developing roller. The main pole P1 had a half-value width of 18° and flux density of 102 mT, as measured with a sensor located at a distance of 1 mm from the magnet.

EXAMPLE 4

To produce a compound material, 4 pts.wt. of fine grains having the following composition and blending ratio were mixed with 96 pts.wt. of anisotropic Sm—Fe—B magnetic powder available from Sumitomo Metal Industries, Ltd. and having a mean grain size of 2.5 μm and then dispersed by agitation. First, to prepare the above fine grains, the resin grains, pigment, charge control agent and parting agent were mixed, dispersed in a molten state by heat above the softening point 67° C. of the resin, pulverized into fine grains after dispersion, and then added with the fluidity imparting agent. The mean grain size of the compound material was 7.3 μm.

Thermoplastic Resin:

| | |
|---|---|
| (1) polyester resin | 79 pts. wt. |
| (2) styrene acryl resin | 7 pts. wt. |

Pigment:

| | |
|---|---|
| carbon black | 7.6 pts. wt. |

Charge Control Agent:

| | |
|---|---|
| zirconium salicylate | 0.9 pts. wt. |

Parting Agent:

| | |
|---|---|
| mixture of carnauba wax and rice wax | 4.3 pts. wt. |

Fluidity Imparting Agent:

| | |
|---|---|
| hydrophobic silica | 1.2 pts. wt |

The resulting compound material was packed in the mold 11 that was 2.3 mm wide, 4.1 mm high, and 306 mm long. A DC electric field was applied to generate a magnetic field of 22,000 Oe. In this condition, the compound material was pressed by 6.5 ton/cm$^2$ at room temperature by horizontal magnetic field molding. In this case, the direction of magnetic field corresponds to the direction of width of the magnet.

A magnet molding, i.e., an Sm—Fe—N magnet thus produced had width of 2.03 mm corresponding to the height of the mold, height of 2.32 mm corresponding to the width of the mold, length of 306.1 mm, and density of 5.15 g/cm$^3$. The magnet was then heated at 100° C. for 30 minutes and then subjected to pulse wave magnetization in a magnetic field of 25 T to thereby complete a rare earth magnet. The rare earth magnet had a magnetic force $BH_{max}$ of 13.2 mGOe, as measured by a VSM gauge.

On the other hand, a magnet compound material made up of a ferrite magnet and EEA resin was molded by extrusion molding in a magnetic field to thereby produce a magnet roller tube having a diameter of 16 mm. Subsequently, a metallic core having a diameter of 6 mm was inserted in the bore of the tube. At this instant, a groove was present in the position of the metallic core corresponding to the main pole or developing pole P1. The groove was 2.25 mm deep, 2.5 mm wide, and 306.1 mm long.

Figure 11:
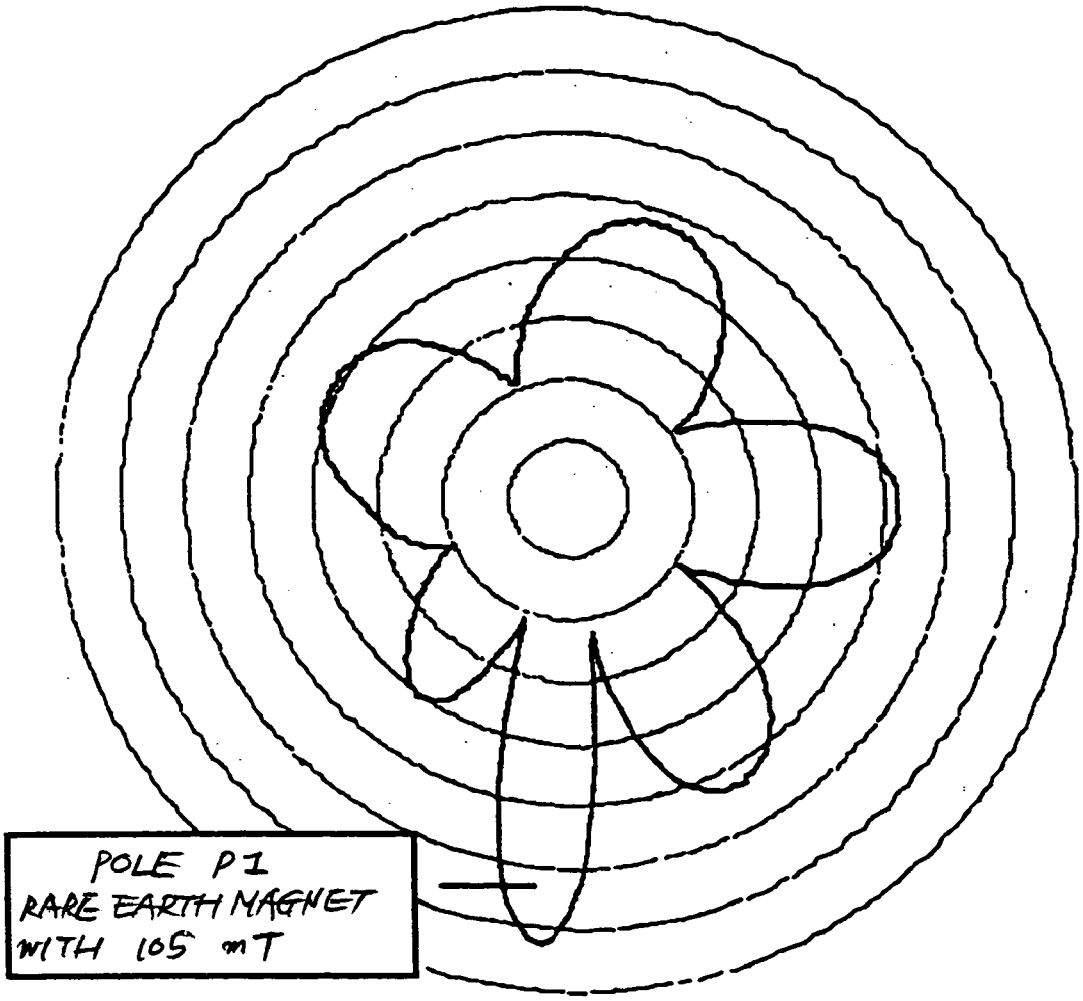
FIG. 11 is a chart showing the flux density distributions particular to a developing roller produced by Example 4 of the present invention.

The magnet molding stated above was fitted in the groove and then affixed by instantaneous adhesive. Subsequently, the molding was magnetized by yoke magnetization to thereby form various poles. Finally, a sleeve and flange were mounted to complete a developing roller. FIG. 11 shows the flux density distributions attained with the developing roller. The main pole P1 had a half-value width of 18° and flux density of 105 mT, as measured with a sensor located at a distance of 1 mm from the magnet.

EXAMPLE 5

To produce a compound material, 7 pts.wt. of fine grains having the following composition and blending ratio were mixed with 93 pts.wt. of anisotropic Nd—Fe—B magnetic powder MFP-12 available from Aichi Steelworks Co., Ltd. and having a mean grain size of 102 μm and then dispersed by agitation. First, to prepare the above fine grains, the resin grains, pigment, charge control agent and parting agent were mixed, dispersed in a molten state by heat above the softening point 75° C. of the resin, pulverized into fine grains after dispersion, and then added with the fluidity imparting agent. The mean grain size of the compound material was 8.5 μm.

Thermoplastic Resin:

| | |
|---|---|
| (1) polyester resin | 79 pts. wt. |
| (2) styrene acryl resin | 7 pts. wt. |

Pigment:

| | |
|---|---|
| carbon black | 7.6 pts. wt. |

Charge Control Agent:

| | |
|---|---|
| zirconium salicylate | 0.9 pts. wt. |

Parting Agent:

| | |
|---|---|
| mixture of carnauba wax and rice wax | 4.3 pts. wt. |

Fluidity Imparting Agent:

| | |
|---|---|
| hydrophobic silica | 1.2 pts. wt. |

The resulting compound material was filled in the mold 11 that was 2.3 mm wide, 4.1 mm high, and 306 mm long. A DC electric field was applied to generate a magnetic field of 13,000 Oe. In this condition, the compound material was pressed by 8.5 ton/cm$^2$ at room temperature by horizontal magnetic field molding. In this case, the direction of magnetic field corresponds to the direction of width of the magnet.

A magnet molding, i.e., an Nd—Fe—B magnet thus produced had width of 2.03 mm corresponding to the height of the mold, height of 2.35 mm corresponding to the width of the mold, length of 306.2 mm, and density of 5.20 g/cm$^3$. The magnet was then heated at 100° C. for 30 minutes and then subjected to pulse wave magnetization in a magnetic field of 25 T to thereby complete a rare earth magnet. The rare earth magnet had a magnetic force $BH_{max}$ of 13.0 mGOe, as measured by a VSM meter.

On the other hand, a magnet compound material made up of a ferrite magnet and EEA resin was molded by extrusion molding in a magnetic field to thereby produce a magnet roller tube having a diameter of 16 mm. Subsequently, a metallic core having a diameter of 6 mm was inserted in the bore of the tube. At this instant, a groove was present in the position of the metallic core corresponding to the main pole or developing pole P1. The groove was 2.25 mm deep, 2.5 mm wide, and 306.1 mm long.

Figure 12:
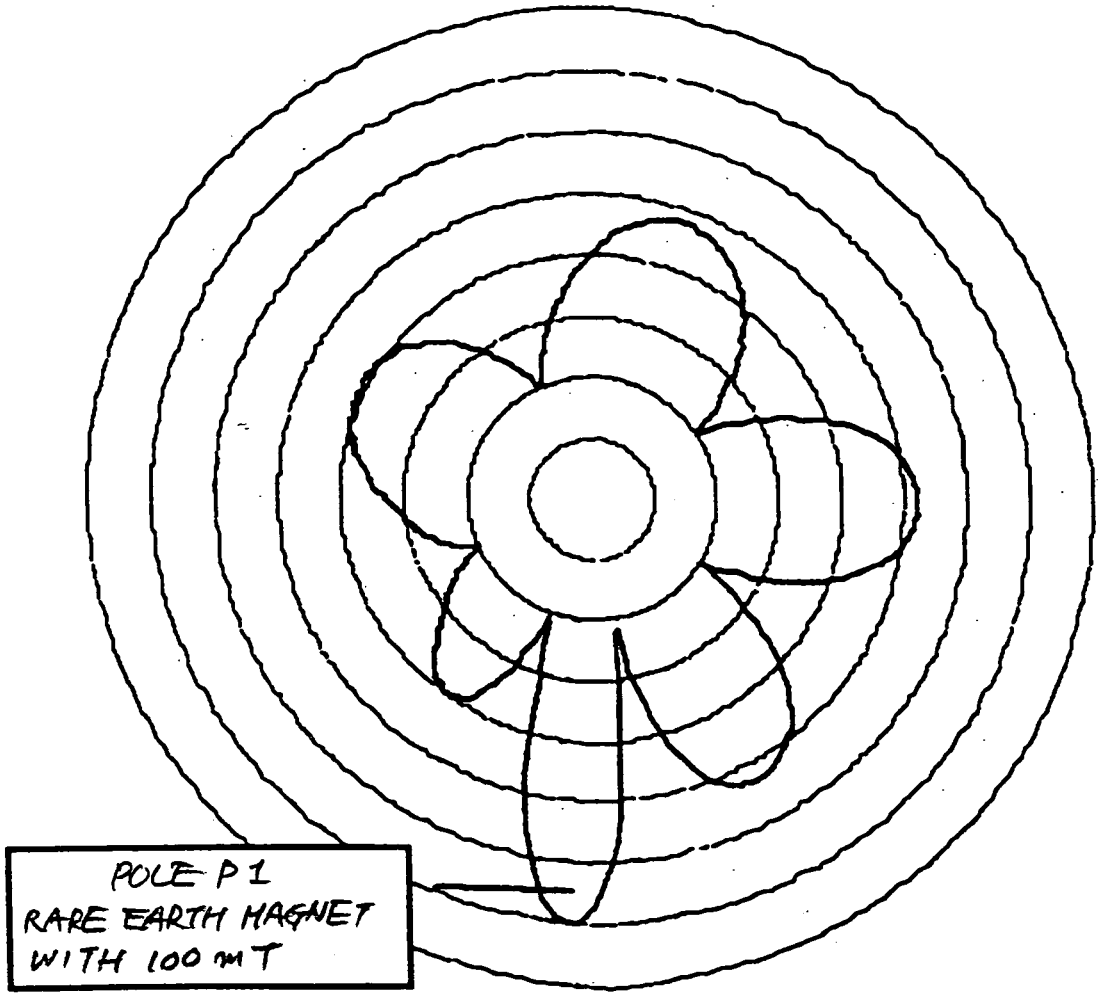
FIG. 12 is a chart showing the flux density distributions particular to a developing roller produced by Example 5 of the present invention.

The magnet molding stated above was fitted in the groove and then affixed by instantaneous adhesive. Subsequently, the molding was magnetized by yoke magnetization to thereby form various poles. Finally, a sleeve and flange were mounted to complete a developing roller. FIG. 12 shows the flux density distributions attained with the developing roller. The main pole P1 had a half-value width of 18° and flux density of 100 mT, as measured with a sensor located at a distance of 1 mm from the magnet.

COMPARATIVE EXAMPLE

To produce a compound material, 7 pts.wt. of fine grains having the following composition and blending ratio were mixed with 93 pts.wt. of anisotropic Nd—Fe—B magnetic powder MFP-12 and having a mean grain size of 102 μm and then dispersed by agitation. The thermoplastic resin had a softening point of 75° C. and a mean grain size of 8.5 μm.

Thermoplastic Resin:

| | |
|---|---|
| (1) polyester resin | 98.8 pts. wt. |

Fluidity Imparting Agent:

| | |
|---|---|
| hydrophobic silica | 1.2 pts. wt. |

The resulting compound material was filled in the mold 11 that was 2.3 mm wide, 4.1 mm high, and 306 mm long. A DC electric field was applied to generate a magnetic field of 13,000 Oe. In this condition, the compound material was pressed by 5.5 ton/cm$^2$ at room temperature by horizontal magnetic field molding. In this case, the direction of magnetic field corresponds to the direction of width of the magnet.

A magnet molding thus produced had width of 2.02 mm corresponding to the height of the mold, height of 2.36 mm corresponding to the width of the mold, length of 306.3 mm, and density of 5.11 g/cm$^3$. The magnet was then heated at 100° C. for 30 minutes and then subjected to pulse wave magnetization in a magnetic field of 25 T to thereby complete a rare earth magnet. The rare earth magnet had a magnetic force $BH_{max}$ of 11.9 mGOe, as measured by a VSM meter.

On the other hand, a magnet compound material made up of a ferrite magnet and EEA resin was molded by extrusion molding in a magnetic field to thereby produce a magnet roller tube having a diameter of 16 mm. Subsequently, a metallic core having a diameter of 6 mm was inserted in the bore of the tube. At this instant, a groove was present in the position of the metallic core corresponding to the main pole or developing pole P1. The groove was 2.25 mm deep, 2.5 mm wide, and 306.1 mm long.

Figure 13:
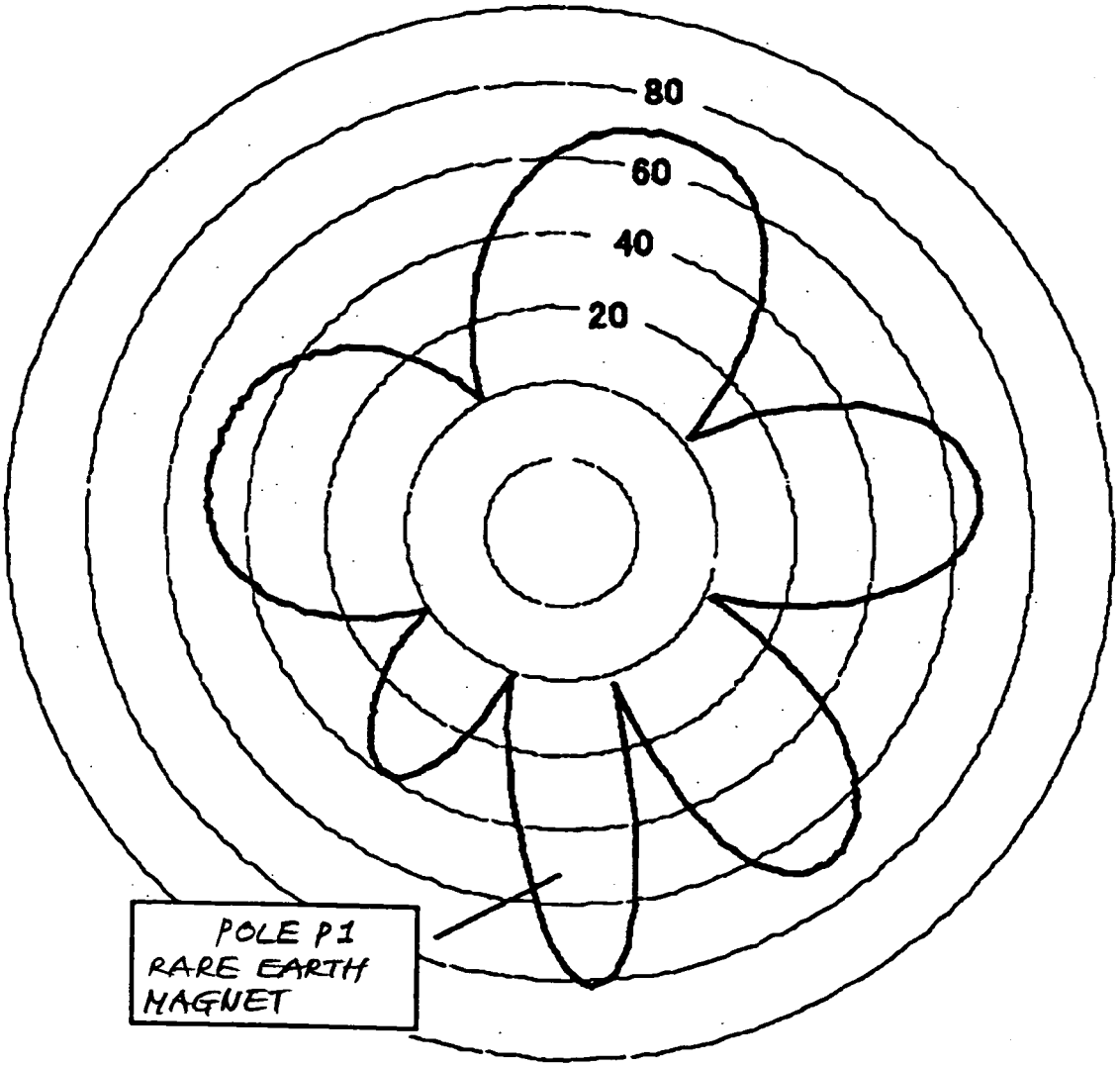
FIG. 13 is a chart showing the flux density distributions particular to a developing roller produced by Comparative Example 1.

The magnet molding stated above was fitted in the groove and then affixed by instantaneous adhesive. Subsequently, the molding was magnetized by yoke magnetization to thereby form various poles. Finally, a sleeve and flange were mounted to complete a developing roller. FIG. 13 shows the flux density distributions attained with the developing roller. The main pole P1 had a half-value width of 18° and flux density of 81 mT, as measured with a sensor located at a distance of 1 mm from the magnet.

COMPARATIVE EXAMPLE 2

A compound material was implemented by MF-202 (trade name) for bond magnets available from Aichi Steelworks Co., Ltd. and containing an epoxy resin binder dispersed therein. The mother magnet material of MF-202 is anisotropic Nd—Fe—B magnetic powder MFP-12. The mean grain size of the compound material was 110 μm.

The compound material was filled in the mold 11 that was 2.3 mm wide, 4.1 mm high, and 306 mm long. A DC electric field was applied to generate a magnetic field of 13,000 Oe. In this condition, the compound material was pressed by 5.5 ton/cm$^2$ at room temperature by horizontal magnetic field molding. In this case, the direction of magnetic field corresponds to the direction of width of the magnet.

A magnet molding thus produced had width of 2.02 mm corresponding to the height of the mold, height of 2.36 mm corresponding to the width of the mold, length of 306.3 mm, and density of 5.02 g/cm$^3$. The magnet was then heated at 150° C. for 60 minutes and then subjected to pulse wave magnetization in a magnetic field of 25 T to thereby complete a rare earth magnet. The rare earth magnet had a magnetic force $BH_{max}$ of 10.8 mGOe, as measured by a VSM meter.

On the other hand, a magnet compound material made up of a ferrite magnet and EEA resin was molded by extrusion molding in a magnetic field to thereby produce a magnet roller tube having a diameter of 16 mm. Subsequently, a metallic core having a diameter of 6 mm was inserted in the bore of the tube. At this instant, a groove was present in the position of the metallic core corresponding to the main pole or developing pole P1. The groove was 2.25 mm deep, 2.5 mm wide, and 306.1 mm long.

Figure 14:
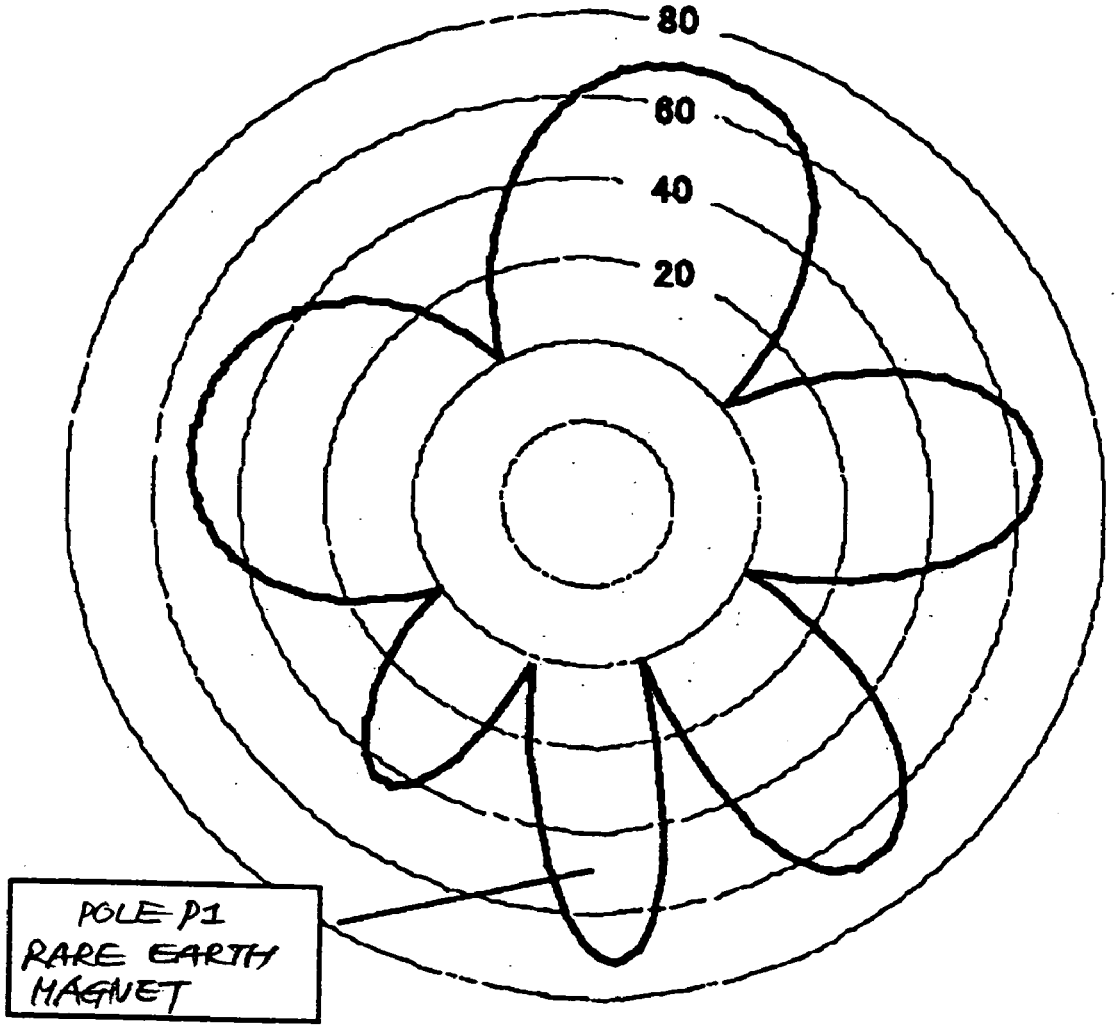
FIG. 14 is a chart showing the flux density distributions particular to a developing roller produced by Comparative Example 2.

The magnet molding stated above was fitted in the groove and then affixed by instantaneous adhesive. Subsequently, the molding was magnetized by yoke magnetization to thereby form various poles. Finally, a sleeve and flange were mounted to complete a developing roller. FIG. 14 shows the flux density distributions attained with the developing roller. The main pole P1 had a half-value width of 18° and flux density of 71 mT, as measured with a sensor located at a distance of 1 mm from the magnet.

FIG. 15 shows physical properties determined by experiments with conventional binders and binders unique to the present invention under similar molding conditions. In FIG. 15, thermoplastic resins all were implemented by polyester resins. 84.5 wt. % of thermoplastic polyester resin, 8.4 wt. % of carbon black, 1.7 wt. % of charge control agent and 4.2 wt. % of wax were mixed to prepare fine grains. The magnetic characteristics of a magnet greatly depend on the binder blending ratio, orientation magnetic field, pressing pressure, and baking conditions. As for the directionality of factors that increase the magnetic characteristics, the binder blending ratio is ↓, the orientation magnetic field is ↑, the pressure is ↑, the baking temperature is ↓, and the baking time is ↓.

As FIG. 15 indicates, for a given magnetic field, a magnet molding using only the thermoplastic resin (plus fluidity imparting agent) has a magnetic force as strong as 11.1 mGOe to 13.1 mGOe. Assuming a 2.0 mm wide, 2.3 mm high, 306 mm long magnet molding, the above magnetic force $(BH)_{max}$ translates into flux density of 83 mT to 97 mT on the sleeve of a magnet roller, meaning an increment of 14 mT (17%). Although the strength of the magnet molding of the present invention is lower in strength than one containing a binder implemented by thermosetting epoxy resin, the magnet molding applied to a magnet roller is free from extraneous stresses and therefore does not need great strength because it is received in the groove of a plastic magnet and covered with a sleeve. Experiments showed that strength of about 3.0 kg/mm$^2$ was sufficient for the magnet molding to be adhered without being broken.

As stated above, the magnet compound material of the present invention contains magnetic powder and thermoplastic resin dispersed therein and allows the magnetic powder to be easily oriented by a magnetic field while achieving high density. The magnetic mixture therefore realizes a magnet molding having a strong magnetic force.

Figure 16:
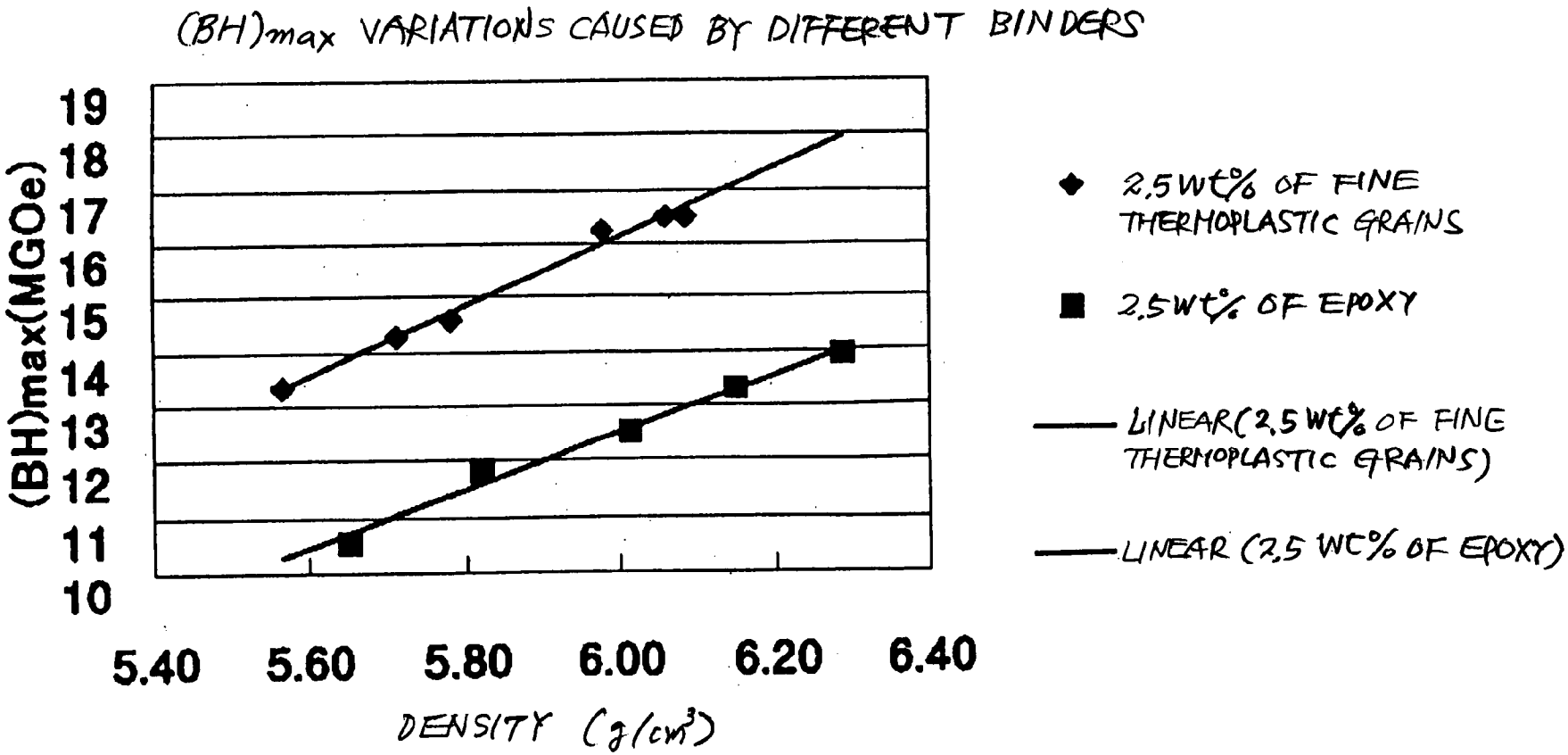
FIG. 16 is a graph comparing the present invention and prior art as to the $(BH)_{max}$ value.

With the above magnet compound material, it is possible to increase the flux density of a particular pole provided on a magnet roller. FIG. 16 compares the magnet compound material of the present invention and conventional magnet compound material as to the variation of $(BH)_{max}$ determined with a magnet roller, which was molded in a magnetic field by a DC electric field of 13,000 Oe and then magnetized by a pulse wave of 25 T. As shown, the compound material of the present invention, containing 2.5 wt. % of fine, thermoplastic resin grains, has a far higher orientation ability than the conventional compound material containing 2.5 wt. % of epoxy resin deposited on magnetic powder, exerting a strong magnetic force.

As for a material of the type whose magnetic force noticeably decreases when subject to heat, it is extremely important to lower molding temperature in order to increase the magnetic force. The present invention allows a magnet to be molded at temperature of 90° C. or below for thereby reducing thermal demagnetization to 5.0% or below, so that a magnet roller with a strong magnetic force is achievable. By further adding fine grains of fluidity imparting agent subjected to hydrophobic processing, it is possible to improve the fluidity of the powder for thereby promoting the smooth, efficient feed of the powder to a mold. The resulting magnet can therefore be provided with a desirable magnetic force distribution.

When the mean grain size of the fine, thermoplastic resin grains is made far smaller than the mean grain size of the magnetic powder, the former can be densely packed in the gaps of the latter, improving both of the strength and magnetic force of the magnet.

If temperature inside a mold is higher than the softening point of a thermoplastic resin, then the resin softens or melts and causes a magnet compound material to cohere, making uniform packing difficult to achieve and therefore rendering the density distribution irregular. By contrast, in accordance with the present invention, heating temperature lower than the softening point suffices and allows the resin to soften, increases molding density, and enhances orientation, thereby realizing a strong magnetic force.

The present invention uses horizontal magnetic field molding, which applies a magnetic field in a direction perpendicular to a pressing direction and implements higher density than vertical magnetic field molding, and can therefore increase the magnetic force. Further, horizontal magnetic field molding stabilizes flux density, i.e., reduces deviation of a magnet roller while stabilizing the dimensional accuracy of the roller.

The (BH)max value of 13 mGOe or above unique to the present invention implements flux density required of a particular pole, e.g., a developing pole, provided on the magnet roller of an SLIC developing roller. In addition, because the diameter of the magnet roller can be reduced, a strong magnetic force is achievable with small dimensions, mainly a dimension in the direction of height, even when the position of the magnet molding is limited.

Various modifications will become possible for those skilled in the art after receiving the teachings of the present disclosure without departing from the scope thereof.

What is claimed is:

1. A method of producing a magnet molding, comprising:

compression-molding a magnet compound material comprising a magnetic powder and fine thermoplastic resin grains having a softening point of 90° C. or below while heating the magnetic powder to a temperature lower than the softening point by 10° to 40° C., said thermoplastic resin grains being one-tenth of the mean grain size of the magnetic powder, and while applying an orienting magnetic field to the magnet compound material in a direction that is perpendicular to the direction of compression molding, said magnetic compound material comprising at least one of a pigment and a charge control agent such that the total amount of non-magnetic ingredients ranges from 3 to 10 wt % of all ingredients of the magnetic compound material.

2. The method as claimed in claim 1, wherein the thermoplastic resin grains comprise spherical grains produced by polymerization of a thermoplastic resin material.

3. The method as claimed in claim 1, wherein a mixture of the thermoplastic resin grains and at least one of the pigment and the charge control agent comprises a kneaded compound of spherical grains.

4. The method as claimed in claim 1, which further comprises a fluidity imparting agent of fine grain structure having surfaces that are subjected to hydrophobic processing.

5. The method as claimed in claim 1, wherein the fluidity imparting agent is present in an amount of 0.3 wt. % and 0.8 wt. % of the entire amount of magnetic compound material.

6. A magnet molding that is prepared by a method, comprising:

compression-molding a magnetic compound material comprising a magnetic powder and fine thermoplastic resin grains having a softening point of 90° C. or below while heating the magnetic powder to a temperature lower than the softening point by 10° to 40° C., said thermoplastic resin grains being one-tenth of the mean grain size of the magnetic powder, and while applying an orienting magnetic field to the magnet compound material in a direction that is perpendicular to the direction of compression molding, said magnetic compound material comprising at least one of a pigment and a charge control agent such that the total amount of non-magnetic ingredients ranges from 3 to 10 wt % of all ingredients of the magnetic compound material.

7. The magnetic molding as claimed in claim 6, wherein the thermoplastic resin grains comprise spherical grains produced by polymerization of a thermoplastic resin material.

8. The magnetic molding as claimed in claim 6, wherein a mixture of the thermoplastic resin grains and at least one of the pigment and the charge control agent comprises a kneaded compound of spherical grains.

9. The magnetic molding as claimed in claim 6, which further comprises a fluidity imparting agent of fine grain structure having surfaces that are subjected to hydrophobic processing.

10. The magnetic molding as claimed in claim 6, wherein the fluidity imparting agent is present in an amount of 0.3 wt. % and 0.8 wt. % of the entire amount of magnetic compound material.

11. The magnetic molding as claimed in claim 6, wherein the magnetic force of the magnetic molding is at least 13 mGOE.

* * * * *